US008744329B2

(12) United States Patent
Yamada

(10) Patent No.: US 8,744,329 B2
(45) Date of Patent: Jun. 3, 2014

(54) FIXING DEVICE AND IMAGE FORMING APPARATUS INCORPORATING SAME

(75) Inventor: Masamichi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 231 days.

(21) Appl. No.: 13/400,824

(22) Filed: Feb. 21, 2012

(65) Prior Publication Data

US 2012/0224894 A1 Sep. 6, 2012

(30) Foreign Application Priority Data

Mar. 4, 2011 (JP) ..... 2011-047590

(51) Int. Cl.
*G03G 15/20* (2006.01)
*G03G 21/16* (2006.01)
*G03G 15/00* (2006.01)

(52) U.S. Cl.
CPC .... *G03G 15/2071* (2013.01); *G03G 2221/1675* (2013.01); *G03G 21/1685* (2013.01); *G03G 15/55* (2013.01); *G03G 21/1638* (2013.01)
USPC ..... 399/327; 399/320; 399/122

(58) Field of Classification Search
USPC ..... 399/122, 320, 327
See application file for complete search history.

(56) References Cited

U.S. PATENT DOCUMENTS

| | | | | |
|---|---|---|---|---|
| 6,088,558 | A | 7/2000 | Yamada et al. | |
| 6,091,926 | A | 7/2000 | Yamada | |
| 6,351,619 | B1 | 2/2002 | Yamada | |
| 6,553,204 | B1 | 4/2003 | Yamada | |
| 6,577,840 | B2 | 6/2003 | Hachisuka et al. | |
| 6,647,215 | B1 * | 11/2003 | Ogle et al. | 399/13 |
| 6,865,363 | B2 | 3/2005 | Hachisuka et al. | |
| 6,925,280 | B2 | 8/2005 | Yamada | |
| 7,228,096 | B2 | 6/2007 | Yamada | |
| 7,359,664 | B2 | 4/2008 | Yamada | |
| 7,751,768 | B2 | 7/2010 | Yamada | |
| 7,890,039 | B2 | 2/2011 | Yamada | |
| 2003/0118356 | A1 * | 6/2003 | Ito et al. | 399/13 |
| 2006/0147226 | A1 * | 7/2006 | Sato et al. | 399/122 |
| 2010/0189477 | A1 | 7/2010 | Yamada | |
| 2010/0226700 | A1 | 9/2010 | Yamada et al. | |

(Continued)

FOREIGN PATENT DOCUMENTS

| | | |
|---|---|---|
| CN | 1430111 A | 7/2003 |
| JP | 2004-333683 | 11/2004 |
| JP | 2008-40053 | 2/2008 |

OTHER PUBLICATIONS

Office Action issued Feb. 12, 2014 in Chinese Patent Application No. 201210043346.0 (5 pages).

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A fixing device includes a fixing rotary body rotatable in a predetermined direction of rotation; a pressing rotary body, rotatable in a direction counter to the direction of rotation of the fixing rotary body, pressed against the fixing rotary body to form a fixing nip therebetween through which a recording medium bearing a toner image is conveyed; a joint connected to a shaft of one of the fixing rotary body and the pressing rotary body and rotatable to rotate the one of the fixing rotary body and the pressing rotary body; and a fixing knob detachably attached to the joint and rotated manually by a user.

11 Claims, 12 Drawing Sheets

(56) References Cited

U.S. PATENT DOCUMENTS

2010/0303523 A1 12/2010 Yamada
2011/0222874 A1 9/2011 Yamada
2011/0222881 A1 9/2011 Yamada
2011/0229201 A1 9/2011 Yamada

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2011-047590, filed on Mar. 4, 2011, in the Japanese Patent Office, the entire disclosure of which is hereby incorporated herein by reference.

FIELD OF THE INVENTION

Exemplary aspects of the present invention relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing roller and a pressing roller that apply heat and pressure to the recording medium bearing the toner image. For example, the pressing roller is pressed against the fixing roller heated by a heater to form a fixing nip therebetween through which the recording medium bearing the toner image is conveyed. As the fixing roller and the pressing roller rotating in the recording medium conveyance direction convey the recording medium through the fixing nip, the fixing roller heated by the heater and the pressing roller apply heat and pressure to the recording medium, melting and fixing the toner image on the recording medium.

During the fixing operation described above, toner may adhere to the outer circumferential surface of the pressing roller from the toner image on the recording medium and remain there even after the fixing operation. In order to remove the residual toner, a web made of a nonwoven fabric impregnated with silicone oil contacts the outer circumferential surface of the pressing roller. The web is supplied from a supply reel and taken up by a take-up reel. For example, as the take-up reel pulls the web from the supply reel, the web stretched between the take-up reel and the supply reel moves slowly and slides over the outer circumferential surface of the pressing roller, thus wiping the residual toner off the pressing roller.

However, if the recording medium is jammed at the fixing nip, a user may rotate the pressing roller in the direction counter to the recording medium conveyance direction to pick up the jammed recording medium from between the fixing roller and the pressing roller. Accordingly, the pressing roller rotating in the direction counter to the recording medium conveyance direction may pull the redundant web from the supply reel, producing slack in the web. Consequently, the slackened web may be entangled or skewed, resulting in faulty conveyance of the web and faulty cleaning of the pressing roller.

To address this problem, a brake mechanism that brakes the moving web is proposed. For example, the brake mechanism includes a pad separatably pressed against the web by a cam. When the cam presses the pad against the web, the pad minimizes movement of the web, preventing slack in the web. However, the brake mechanism has the complex structure that upsizes the fixing device and increases manufacturing costs.

Alternatively, a method for taking up the web after the user removes the jammed recording medium is proposed. For example, after the user removes the jammed recording medium, the take-up reel takes up the web a plurality of times while the fixing roller and the pressing roller are rotated for a predetermined time, unreeling the fresh web and cleaning the pressing roller precisely with the fresh web.

Although effective for its intended purpose, this method has a drawback in that if the user rotates the pressing roller accidentally even when no recording medium is jammed between the fixing roller and the pressing roller, and therefore the pressing roller pulls the redundant web from the supply reel, this method may not activate because it is configured to activate solely after removal of the jammed recording medium. Accordingly, slack in the redundant web may not be eliminated, resulting in faulty conveyance of the web and faulty cleaning of the pressing roller.

SUMMARY OF THE INVENTION

This specification describes below an improved fixing device. In one exemplary embodiment of the present invention, the fixing device includes a fixing rotary body rotatable in a predetermined direction of rotation; a pressing rotary body, rotatable in a direction counter to the direction of rotation of the fixing rotary body, pressed against the fixing rotary body to form a fixing nip therebetween through which a recording medium bearing a toner image is conveyed; a joint connected to a shaft of one of the fixing rotary body and the pressing rotary body and rotatable to rotate the one of the fixing rotary body and the pressing rotary body; and a fixing knob detachably attached to the joint and rotated manually by a user.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
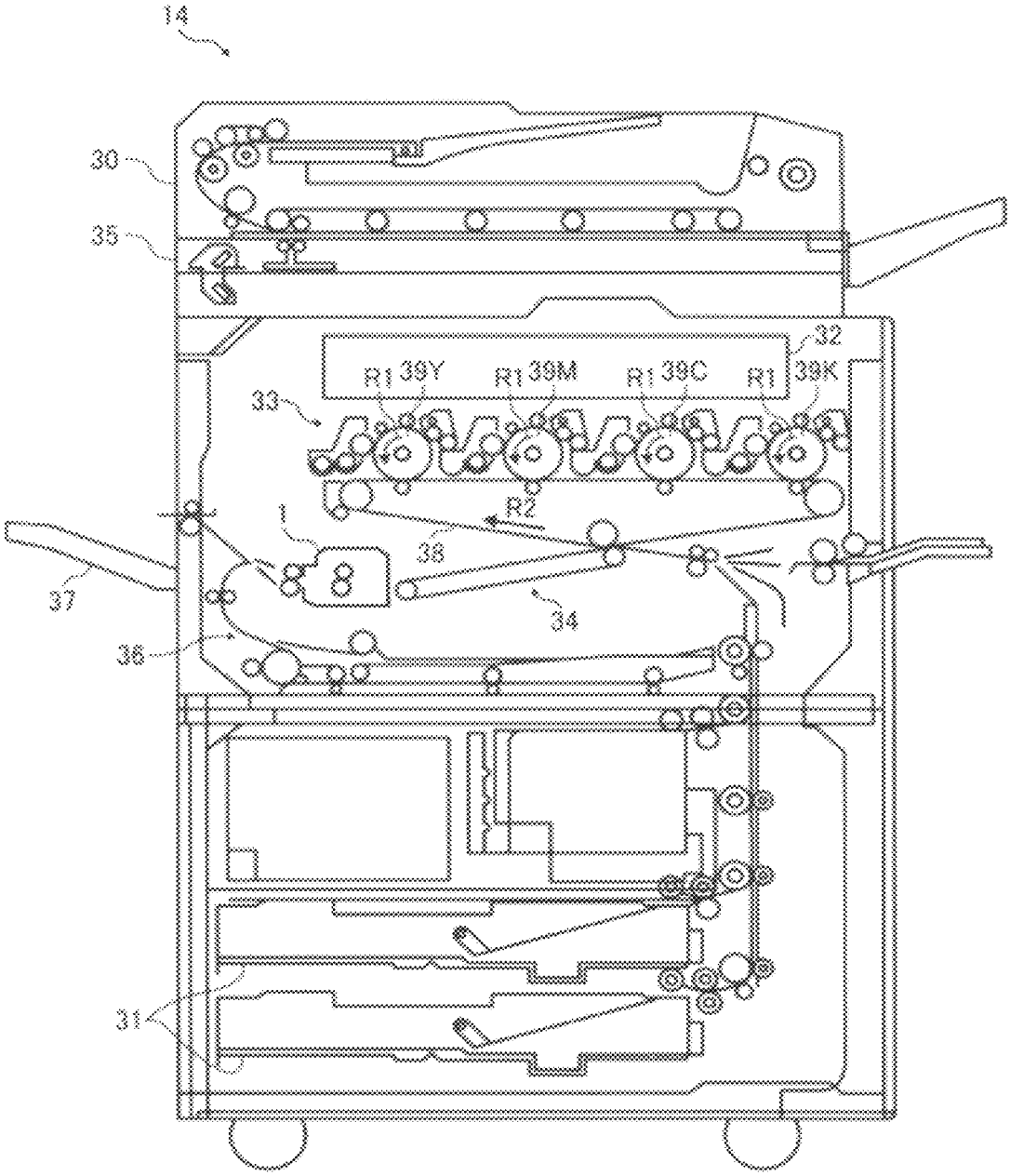
FIG. 1 is a schematic sectional view of an image forming apparatus according to a first embodiment.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 14 according to an exemplary embodiment of the present invention is explained.

FIG. 1 is a schematic sectional view of the image forming apparatus 14. The image forming apparatus 14 may be a copier, a facsimile machine, a printer, a multifunction printer having at least one of copying, printing, scanning, plotter, and facsimile functions, or the like. According to this exemplary embodiment, the image forming apparatus 14 is a color copier for forming color and monochrome images on a recording medium by electrophotography.

The image forming apparatus 14 includes an auto document feeder (ADF) 30 disposed atop the image forming apparatus 14; a reader 35 disposed below the ADF 30; a writer 32 disposed below the reader 35; an image forming device 33 disposed below the writer 32 and including photoconductors 39Y, 39M, 39C, and 39K; a transfer device 34 disposed below the image forming device 33 and including a transfer belt 38; a fixing device 1 disposed below the transfer device 34; a duplex unit 36 disposed below the fixing device 1; a plurality of paper trays 31 disposed below the duplex unit 36 in a lower portion of the image forming apparatus 14, each of which loads a plurality of recording media (e.g., sheets); and an output tray 37 attached to one side of the image forming apparatus 14.

A detailed description is now given of the structure and operation of the image forming apparatus 14 having the components described above.

The ADF 30 feeds an original document bearing an image to the reader 35. The reader 35 (e.g., a scanner) reads the image on the original document into yellow, magenta, cyan, and black image data and sends the image data to the writer 32. The writer 32 emits laser beams onto a charged outer circumferential surface of the respective photoconductors 39Y, 39M, 39C, and 39K rotating in a rotation direction R1 according to the yellow, magenta, cyan, and black image data sent from the reader 35, thus forming an electrostatic latent image on the respective photoconductors 39Y, 39M, 39C, and 39K. Alternatively, the writer 32 emits laser beams according to image data sent from an external device such as a client computer.

Then, development devices disposed opposite the photoconductors 39Y, 39M, 39C, and 39K supply yellow, magenta, cyan, and black toners to the electrostatic latent images formed on the photoconductors 39Y, 39M, 39C, and 39K, thus rendering the electrostatic latent images visible as yellow, magenta, cyan, and black toner images, respectively. Thereafter, primary transfer rollers of the transfer unit 34 disposed opposite the photoconductors 39Y, 39M, 39C, and 39K primarily transfer the yellow, magenta, cyan, and black toner images onto the transfer belt 38 rotating in a rotation direction R2 in such a manner that the yellow, magenta, cyan, and black toner images are superimposed on the same position on the transfer belt 38, thus forming a color toner image on the transfer belt 38. On the other hand, a feed roller feeds a recording medium from one of the paper trays 31 to a registration roller pair. The registration roller pair feeds the recording medium to the transfer belt 38 at a time when a secondary transfer roller of the transfer unit 34 secondarily transfers the color toner image from the transfer belt 38 onto the recording medium. Then, the recording medium bearing the color toner image is conveyed to the fixing device 1. The fixing device 1 applies heat and pressure to the recording medium, thus fixing the color toner image on the recording medium. Thereafter, the recording medium bearing the fixed toner image is discharged onto the output tray 37.

Alternatively, if a duplex printing mode for forming a toner image on both sides (e.g., front and back sides) of the recording medium is selected by a user, the recording medium bearing the fixed toner image is conveyed to the duplex unit 36 that reverses the recording medium and sends it to the transfer device 34. The transfer device 34 transfers another color toner image from the transfer belt 38 onto the back side of the recording medium. Thereafter, the recording medium bearing the toner image on both sides thereof is conveyed to the fixing device 1, and then discharged onto the output tray 37.

Figure 2:
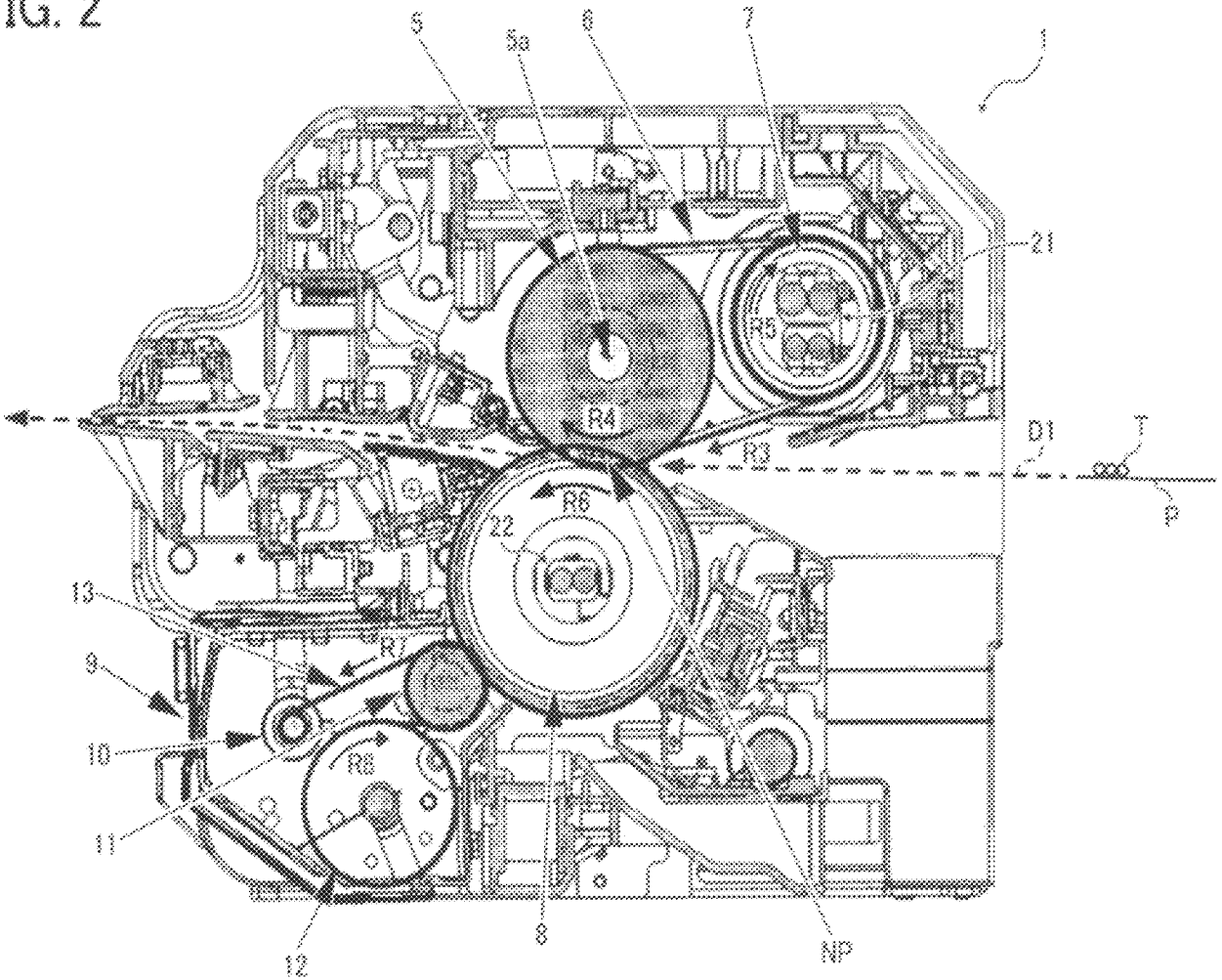
FIG. 2 is a vertical sectional view of a fixing device installed in the image forming apparatus shown in FIG. 1.

Referring to FIG. 2, the following describes the fixing device 1 installed in the image forming apparatus 14 having the structure described above.

FIG. 2 is a vertical sectional view of the fixing device 1. As shown in FIG. 2, the fixing device 1 (e.g., a fuser unit) includes a fixing belt 6, rotatable in a rotation direction R3, formed into a loop stretched over a fixing roller 5 serving as a fixing rotary body rotatable in a rotation direction R4 and a heating roller 7 rotatable in a rotation direction R5; a pressing roller 8, serving as a pressing rotary body rotatable in a rotation direction R6, pressed against the fixing roller 5 via the fixing belt 6 to form a fixing nip NP between the pressing roller 8 and the fixing belt 6; a halogen heater 21, serving as a heater or a heat source, disposed inside the heating roller 7 to heat the heating roller 7; a halogen heater 22, serving as a heater or a heat source, disposed inside the pressing roller 8 to heat the pressing roller 8; and a cleaner 9 disposed opposite an outer circumferential surface of the pressing roller 8. As a recording medium P bearing an unfixed toner image T is conveyed through the fixing nip NP in a conveyance path shown in the broken line, the fixing belt 6 and the pressing roller 8 apply heat and pressure to the recording medium P to melt and fix the toner image T on the recording medium P.

A detailed description is now given of the structure of the components incorporated in the fixing device 1.

The fixing belt 6 having an inner loop diameter of about 80 mm is constructed of a base layer having a thickness of about 90 micrometers and made of polyimide resin; an elastic layer disposed on the base layer, having a thickness of about 200 micrometers, and made of silicone rubber; and an outer surface layer disposed on the elastic layer, having a thickness of about 20 micrometers, and made of tetrafluoroethylene-perfluoroalkylvinylether copolymer (PFA). The endless fixing belt 6 is looped over the fixing roller 5 having an outer diameter of about 54 mm and the heating roller 7 constructed of an aluminum hollow cylinder having an outer diameter of about 40 mm and a thickness not greater than about 1 mm.

The fixing roller 5 is constructed of a tubular heat resistant elastic layer having an outer diameter of about 54 mm and a thickness of about 15 mm and made of silicone rubber or fluororubber.

The pressing roller 8 having an outer diameter of about 65 mm is constructed of a hollow metal core having a thickness of about 1.0 mm and made of steel; an elastic layer disposed on the metal core, having a thickness of about 1.5 mm, and made of silicone rubber; and a tubular outer surface layer disposed on the elastic layer and made of PFA.

When the pressing roller 8 is pressed against the fixing roller 5 via the fixing belt 6 as shown in FIG. 2, the pressing roller 8 is engaged in the fixing roller 5 by about 4 mm, forming the fixing nip NP having a length of about 16 mm in the rotation direction R6 of the pressing roller 8.

Referring to FIG. 3 to 8C, the following describes a configuration that manually rotates the pressing roller 8 described above.

Figure 3:
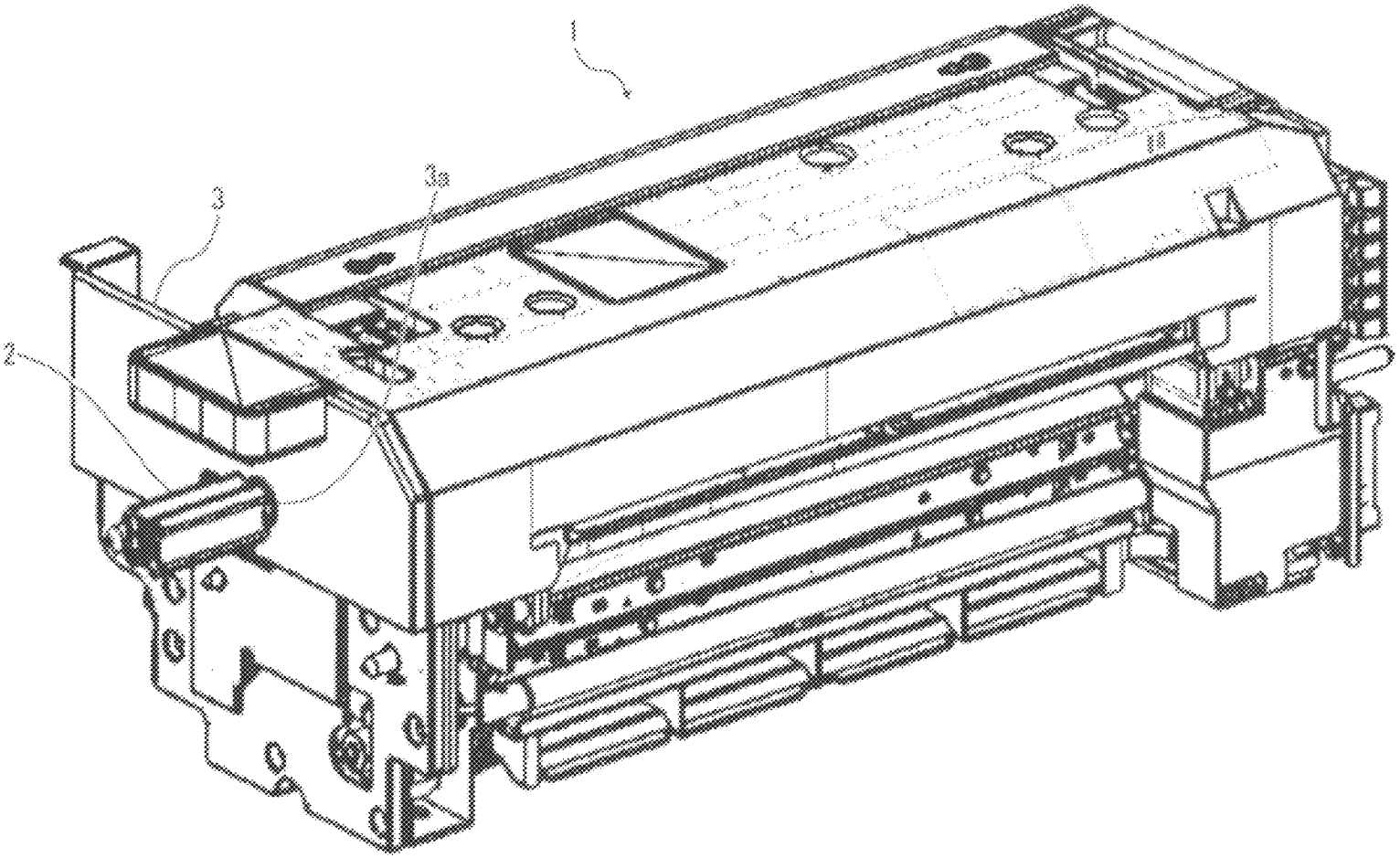
FIG. 3 is a perspective view of the fixing device shown in FIG. 2 attached with a fixing knob.
Figure 4:
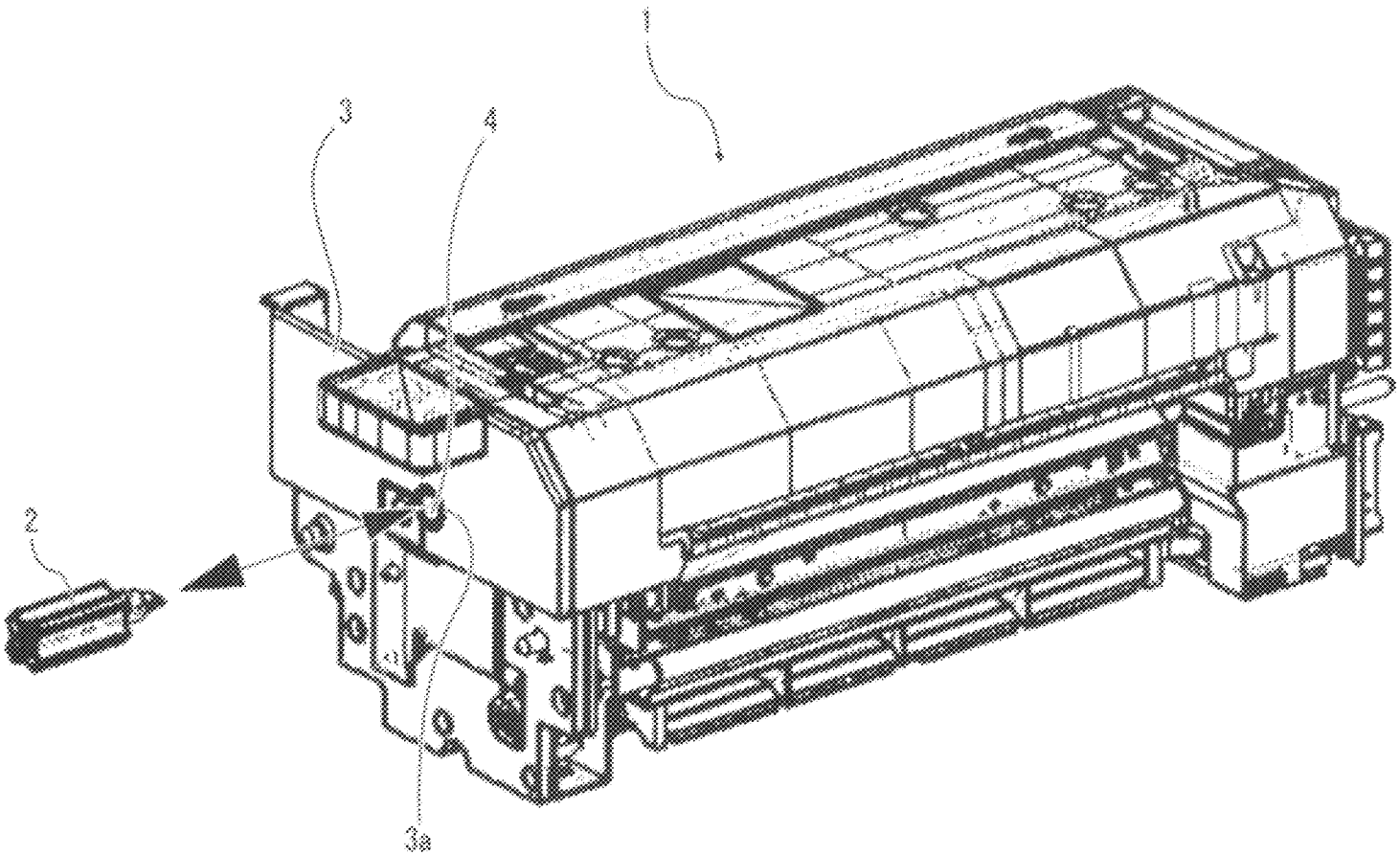
FIG. 4 is a perspective view of the fixing device shown in FIG. 3 and the fixing knob detached from the fixing device.
Figure 5A:
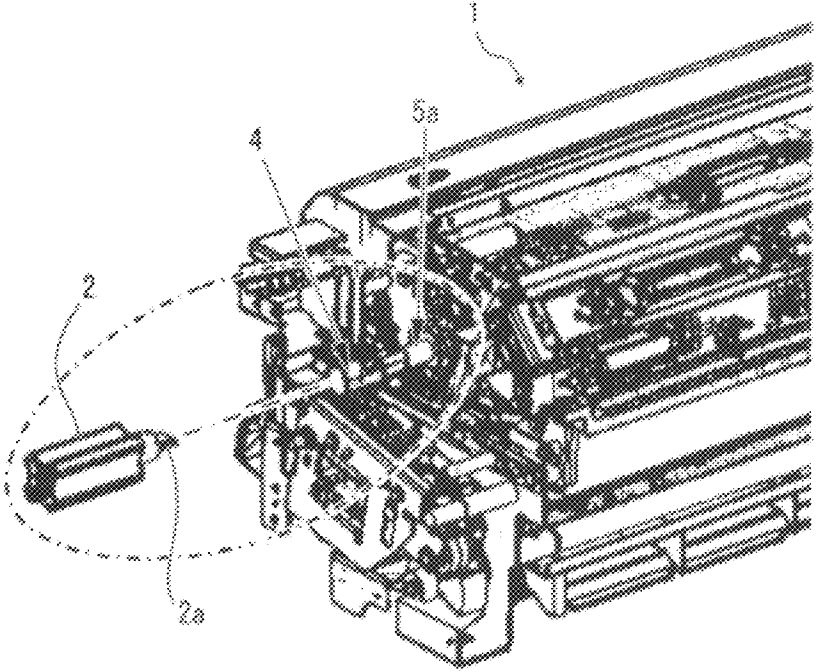
FIG. 5A is a partial perspective view of the fixing device shown in FIG. 4.
Figure 5B:
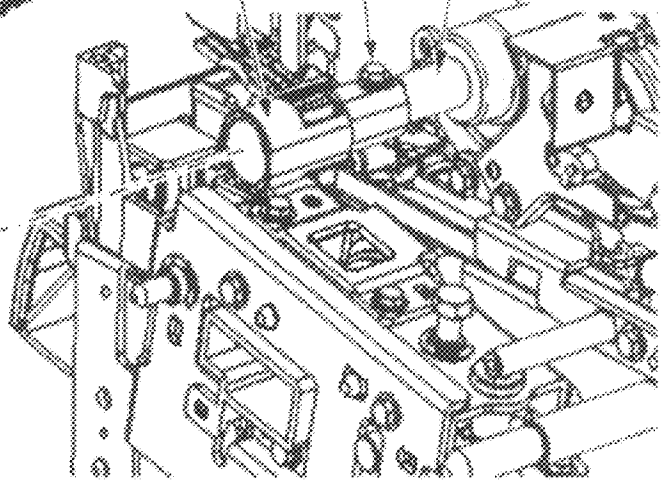
FIG. 5B is an enlarged partial perspective view of the fixing device shown in FIG. 5A.

FIG. 3 is a perspective view of the fixing device 1 attached with a fixing knob 2. FIG. 4 is a perspective view of the fixing device 1 and the fixing knob 2 detached from the fixing device 1. FIG. 5A is a partial perspective view of the fixing device 1. FIG. 5B is an enlarged partial perspective view of the fixing device 1.

As shown in FIG. 3 and 4, the fixing knob 2 is detachably attached to the fixing device 1. A fixing cover 3 is disposed in proximity to one axial end of a shaft 5*a* (depicted in FIG. 5A) of the fixing roller 5 (depicted in FIG. 2) in an axial direction of the fixing roller 5 and covers a front of the fixing device 1. The fixing roller 5 is situated at an interior of the fixing cover 3. The shaft 5*a* of the fixing roller 5 and a shaft of the pressing roller 8 (depicted in FIG. 2) engage a pair of connected gears at a gear rate of 1:1. When the recording medium P bearing the toner image T is conveyed through the fixing nip NP, a driving force generated by a driver is transmitted to the fixing roller 5 and the pressing roller 8 through the pair of connected gears, thus rotating the fixing roller 5 and the pressing roller 8 at an identical circumferential velocity in the rotation direction R4 and the rotation direction R6 that convey the recording medium P in a recording medium conveyance direction D1 at the fixing nip NP as shown in FIG. 2.

As shown in FIG. 5A, the fixing knob 2 detachably engages a joint 4 connected to the shaft 5*a* of the fixing roller 5. Alternatively, the joint 4 may be connected to an arbitrary shaft connected to the driver that drives the fixing roller 5 and the pressing roller 8. For example, the joint 4 may be connected to the shaft of the pressing roller 8. As shown in FIG. 4, a through-hole 3*a* having an inner diameter corresponding to an outer diameter of the joint 4 is produced through the fixing cover 3 that extends orthogonal to an axial direction of the joint 4.

When the recording medium P is jammed between the fixing roller 5 and the pressing roller 8, the user powers off the image forming apparatus 14, inserts the fixing knob 2 into the through-hole 3*a* of the fixing cover 3 as shown in FIG. 3 so that the fixing knob 2 engages the joint 4 situated inboard from the through-hole 3*a*, turns the fixing knob 2 to manually rotate the fixing roller 5 and the pressing roller 8 via the joint 4, the shaft 5*a*, and the pair of connected gears interposed between the fixing roller 5 and the pressing roller 8.

The user can manually rotate the fixing knob 2 both clockwise and counterclockwise. For example, the user can manually rotate the fixing roller 5 and the pressing roller 8 via the pair of connected gears connecting the fixing roller 5 to the pressing roller 8 in directions counter to the rotation directions R4 and R6, respectively, to move the recording medium P in a direction counter to the recording medium conveyance direction D1. Thus, the jammed recording medium P is discharged from the fixing nip NP so that the user can remove the recording medium P from between the fixing roller 5 and the pressing roller 8 readily. The user attaches the fixing knob 2 to the joint 4 by inserting the fixing knob 2 into the through-hole 3*a* and detaches the fixing knob 2 from the joint 4 by pulling the fixing knob 2 out of the joint 4. Usually, the fixing knob 2 is not attached to the fixing device 1. The user attaches the fixing knob 2 to the fixing device 1 only when needed, for example, when the user needs to remove the jammed recording medium P from the fixing device 1.

When the recording medium P is not jammed, that is, when the fixing operation described above is performed properly, the fixing knob 2 is not attached to the joint 4, prohibiting the user from rotating the fixing roller 5 and the pressing roller 8 accidentally and therefore preventing failures caused by accidental rotation of the fixing roller 5 and the pressing roller 8.

The fixing device 1 has the above-described simple configuration in which the fixing knob 2 is detachably attached to the joint 4 that is directly connected to the shaft 5*a* of the fixing roller 5 and indirectly connected to the shaft of the pressing roller 8 via the pair of connected gears or connected to an arbitrary shaft connected to the driver that drives the fixing roller 5 and the pressing roller 8. Accordingly, the jammed recording medium P is removed from between the fixing roller 5 and the pressing roller 8 with the simple configuration manufactured at reduced costs in which the detachable fixing knob 2 is attached to the joint 4 only for a purpose of removing the jammed recording medium P.

According to the exemplary embodiment described above, the joint 4 is connected to the shaft 5*a* of the fixing roller 5 as shown in FIG. 5A. Alternatively, if the pressing roller 8 is configured to press against a fixing belt instead of the fixing roller 5, for example, if the pressing roller 8 is configured to press against a nip formation pad disposed inside the fixing belt via the fixing belt, the joint 4 may be connected to a shaft of a driver of the fixing belt so that the fixing knob 2 is detachably attached to the joint 4, thus attaining the advantages described above. Such fixing belt as well as the fixing roller 5 serves as a fixing rotary body.

With a fixing device in which the pressing roller 8 is isolated from the fixing rotary body when the recording medium P is jammed, if the joint 4 is attached to the shaft of the fixing rotary body, only the fixing rotary body rotates as the fixing knob 2 attached to the joint 4 is rotated. Conversely, if the joint 4 is attached to the shaft of the pressing roller 8, only the pressing roller 8 rotates as the fixing knob 2 attached to the joint 4 is rotated. However, the above-described advantages are attained.

FIG. 5A illustrates the fixing device 1 from which the fixing cover 3 is detached. The joint 4 is fastened with a screw to a flange mounted on the shaft 5*a* of the fixing roller 5. The fixing knob 2 is detachably attached to the joint 4. The shape of the joint 4 and the fixing knob 2 is illustrated in FIG. 6A to 6D.

Figure 6A:
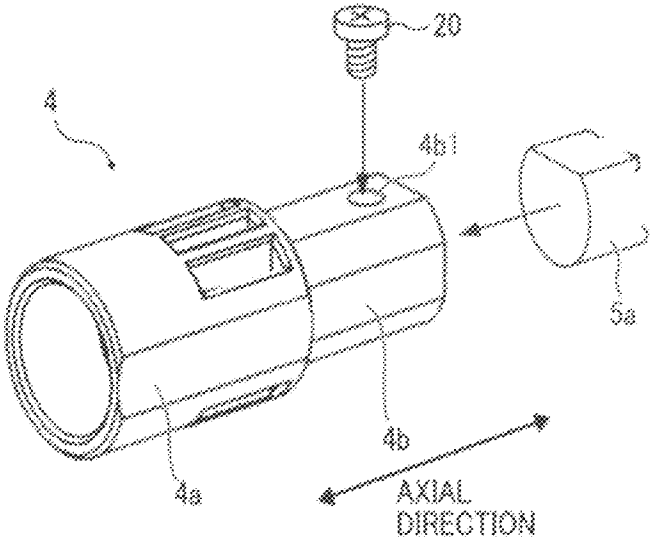
FIG. 6A is a perspective view of a joint incorporated in the fixing device shown in FIG. 5B seen in a direction substantially orthogonal to an axial direction of the joint.
Figure 6B:
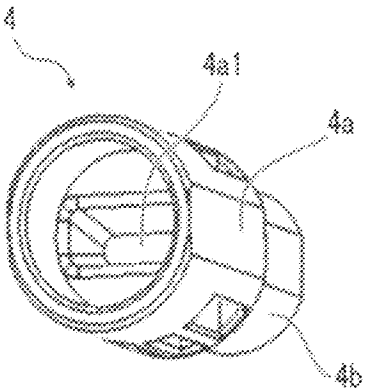
FIG. 6B is a perspective view of the joint shown in FIG. 6A seen in one direction slightly angled from the axial direction of the joint.
Figure 6C:
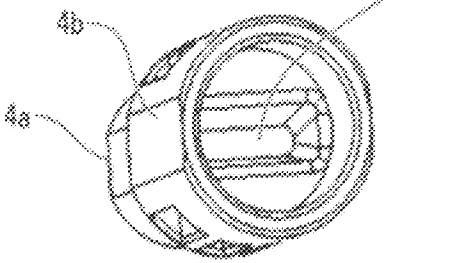
FIG. 6C is a perspective view of the joint shown in FIG. 6A seen in another direction slightly angled from the axial direction of the joint.
Figure 6D:
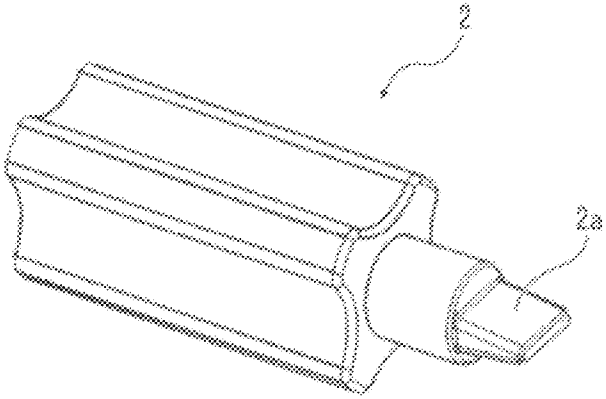
FIG. 6D is a perspective view of the fixing knob shown in FIG. 4.

FIG. 6A is a perspective view of the joint 4 seen in a direction substantially orthogonal to the axial direction of the joint 4. FIG. 6B and 6C illustrate a perspective view of the joint 4 seen in a direction slightly angled from the axial direction of the joint 4. FIG. 6D is a perspective view of the fixing knob 2.

As shown in FIG. 6A, the joint 4 is constructed of two parts: a body 4*a* that engages the fixing knob 2 and a fastening portion 4*b* that is fastened to the shaft 5*a* of the fixing roller 5. The fastening portion 4*b* is a tube into which the D-shaped shaft 5*a* is inserted and fastened with a screw 20 screwed into a screw hole 4*b*1 produced through the fastening portion 4*b*.

As shown in FIG. 6B, the body 4*a* of the joint 4 includes a concave female connector 4*a*1 that engages the fixing knob 2. The concave female connector 4*a*1 is tapered in such a manner that the diameter of the female connector 4*a*1 decreases from an opening to an inner part thereof. As shown in FIG. 6D, the fixing knob 2 includes a convex male connector 2*a* tapered in such a manner that the diameter of the male connector 2*a* decreases from a bottom to a top thereof. Thus, the female connector 4*a*1 engages the male connector 2*a*. When the user manually rotates the fixing knob 2 attached to the joint 4 in a state in which the male connector 2*a* of the fixing knob 2 engages the female connector 4*a*1 of the joint 4, a rotation moment is transmitted from the fixing knob 2 to the joint 4. Since the joint 4 is fastened to the shaft 5*a* of the fixing roller 5 with the screw 20 as shown in FIG. 6A, the rotation moment is transmitted to the fixing roller 5, rotating the fixing roller 5 in a direction that discharges the recording medium P from between the fixing roller 5 and the pressing roller 8.

Since the fixing roller 5 is connected to the pressing roller 8 via the pair of connected gears interposed therebetween, as the user manually rotates the fixing knob 2, the fixing roller 5 and the pressing roller 8 rotate together. The user can manually rotate the fixing knob 2 bidirectionally in the rotation direction R4 depicted in FIG. 2 and a direction counter to the rotation direction R4 according to a circumstance. For example, the user can rotate the fixing knob 2 either in the recording medium conveyance direction D1 or the direction counter to the recording medium conveyance direction D1 according to a condition of the jammed recording medium P, facilitating removal of the jammed recording medium P. The joint 4 having the concave female connector 4*a*1 engageable solely with the male connector 2*a* of the fixing knob 2 prohibits the user from manually rotating the fixing roller 5 and the pressing roller 8 without using the fixing knob 2. Accordingly, the fixing roller 5 and the pressing roller 8 are rotated by the user only when necessary, for example, when the user needs to remove the jammed recording medium P, thus preventing failures that may arise due to accidental rotation of the fixing roller 5 and the pressing roller 8.

Figure 7:
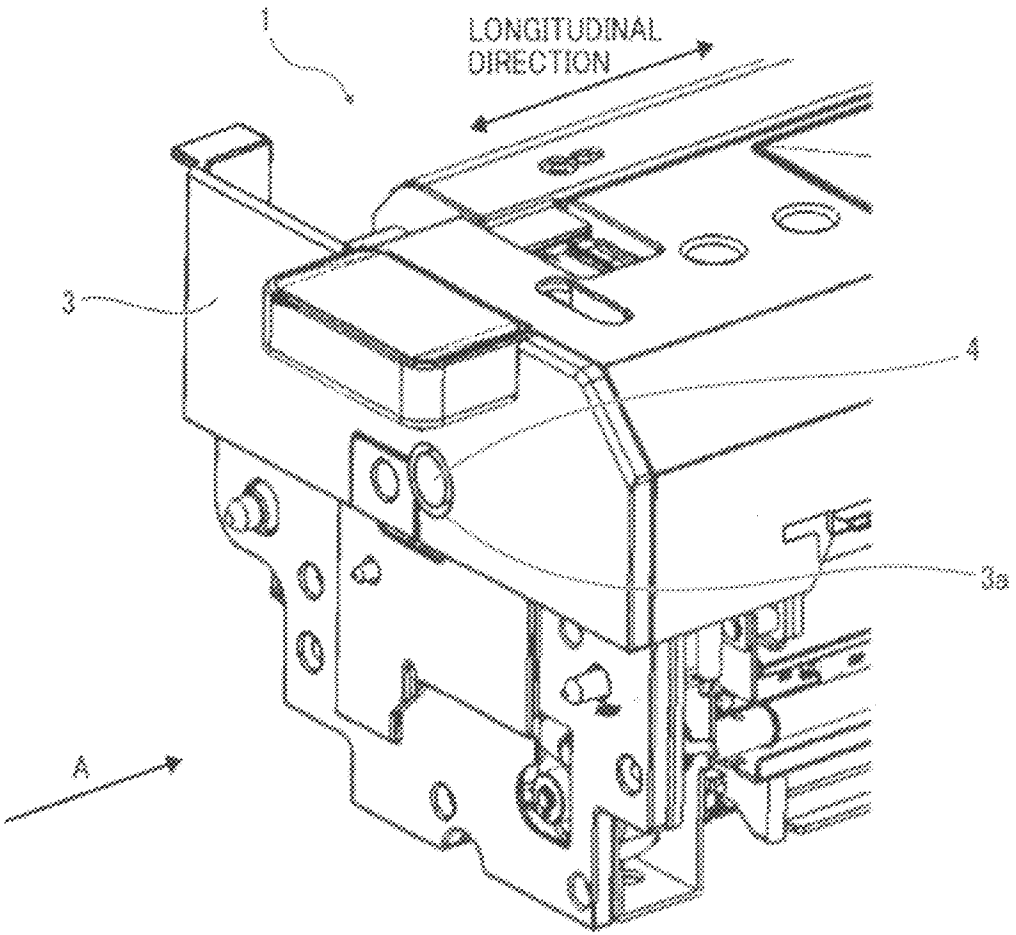
FIG. 7 is a perspective view of the fixing device shown in FIG. 4 illustrating one end of the fixing device in a longitudinal direction thereof.
Figure 8A:
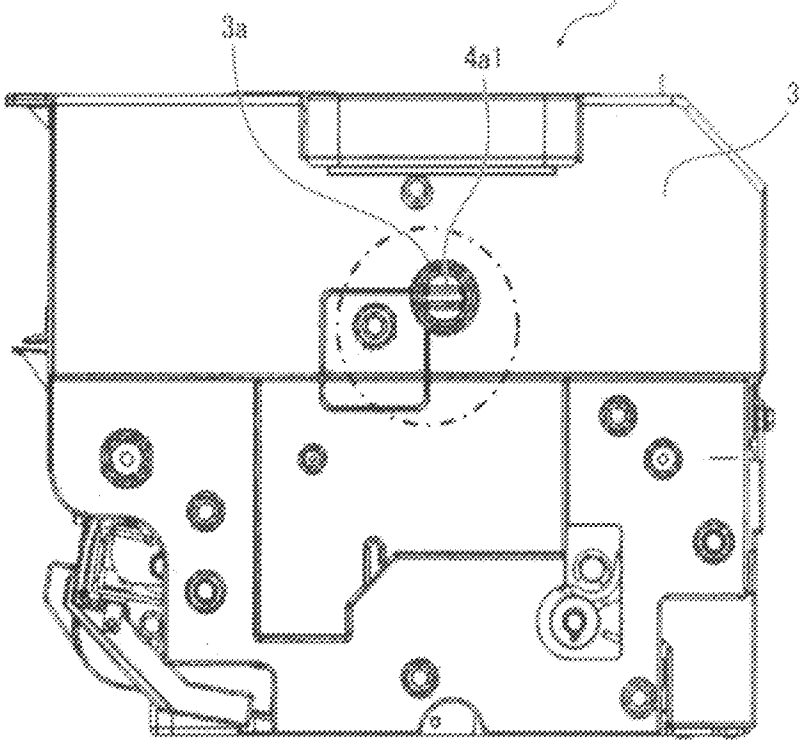
FIG. 8A is a front view of the fixing device shown in FIG. 7 seen in a direction A in FIG. 7.
Figure 8B:
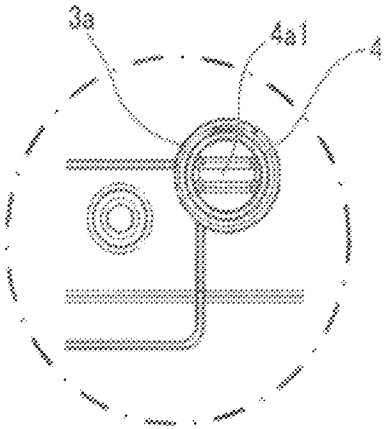
FIG. 8B is a partially enlarged front view of the fixing device shown in FIG. 8A illustrating a through-hole of a fixing cover and a female connector of the joint incorporated therein.
Figure 8C:
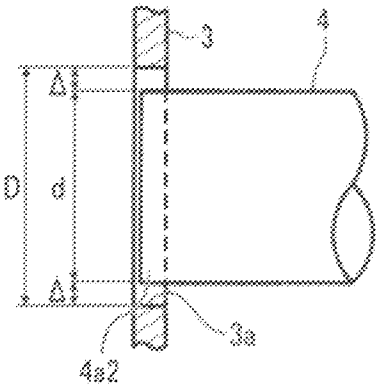
FIG. 8C is a sectional side view of the fixing cover and the joint shown in FIG. 8B.

FIG. 7 is a perspective view of the fixing device 1 illustrating one end of the fixing device 1 in a longitudinal direction thereof, that is, the axial direction of the fixing roller 5, where the fixing cover 3 is situated. FIG. 8A is a front view of the fixing device 1 seen in a direction A in FIG. 7. FIG. 8B is a partially enlarged front view of the fixing device 1 illustrating the through-hole 3*a* of the fixing cover 3 and the female connector 4*a*1 of the joint 4. FIG. 8C is a sectional side view of the fixing cover 3 and the joint 4.

As shown in FIG. 8C, an inlet 4*a*2 of the joint 4 through which the male connector 2*a* of the fixing knob 2 is inserted into the female connector 4*a*1 of the joint 4 is situated inside the circular through-hole 3*a* produced through the fixing cover 3. An outer diameter d of the joint 4 is about 18 mm. An inner diameter D of the through-hole 3*a* is about 24 mm. A clearance A between an interior wall, that is, an inner circumference, of the through-hole 3 and an outer surface wall, that is, an outer circumference, of the joint 4 is about 3 mm. The clearance A is not greater than about 4 mm even with consideration of variation in part size.

Since the joint 4 engages or is connected to the fixing roller 5 or the pressing roller 8, as the fixing device 1 is driven, that is, the fixing roller 5 or the pressing roller 8 is rotated, the joint 4 rotates. Accordingly, the clearance A is needed between the joint 4 and the fixing cover 3. The clearance A is not greater than about 4 mm, prohibiting fingers of the user from touching the driver or heated components of the fixing device 1.

Referring back to FIG. 2, the following describes the cleaner 9 that cleans the outer circumferential surface of the pressing roller 8.

As shown in FIG. 2, the cleaner 9 includes a web 13; a cleaning roller 11 that presses the web 13 against the outer circumferential surface of the pressing roller 8; a supply roller 12 (e.g., a supply reel) that supplies the web 13 to the cleaning roller 11; and a take-up roller 10 (e.g., a take-up reel) that takes up the web 13 from the cleaning roller 11. The cleaning roller 11 is interposed between the supply roller 12 and the take-up roller 10 in a rotation direction R7 of the web 13 and made of a soft material such as foam. The web 13 is a band made of a nonwoven fabric impregnated with silicone oil and cleans the outer circumferential surface of the pressing roller 8. The web 13 is stretched over the supply roller 12, the cleaning roller 11, and the take-up roller 10 in such a manner that the take-up roller 10 pulls the web 13. As the take-up roller 10 takes up the web 13 supplied from the supply roller 12 and moving slowly while the cleaning roller 11 presses the web 13 against the pressing roller 8 with predetermined pressure, the web 13 slides over the outer circumferential surface of the pressing roller 8, removing residual toner (e.g., offset toner) in a slight amount from the outer circumferential surface of the pressing roller 8.

The supply roller 12 does not generate a driving force that feeds the web 13. Instead, the take-up roller 10 drives and rotates the web 13, thus causing the supply roller 12 to supply the web 13 and pulling and taking up the web 13. Accordingly, the supply roller 12, which is rotated freely, is driven and rotated by the web 13 that is rotated by the take-up roller 10 in the rotation direction R7. Consequently, the supply roller 12 is rotated in a rotation direction R8. During fixing operation, the pressing roller 8 rotates counterclockwise in FIG. 2 in the rotation direction R6 identical to the rotation direction R7 of the web 13. Accordingly, the web 13 is stretched between a contact position where the cleaning roller 11 presses the web 13 against the pressing roller 8 and a take-up position where the take-up roller 10 takes up the web 13 with a proper tension, attaining stable conveyance of the web 13. However, in the event that the recording medium P is jammed between the fixing roller 5 and the pressing roller 8, the user needs to rotate the fixing roller 5 in the direction counter to the rotation direction R4 in which the fixing roller 5 rotates during fixing operation by using the fixing knob 2. In accordance with this rotation of the fixing roller 5, the pressing roller 8 also rotates in a direction counter to the rotation direction R6 in which the pressing roller 8 rotates during fixing operation. Accordingly, the proper tension of the web 13 created between the contact position where the cleaning roller 11 presses the web 13 against the pressing roller 8 and the take-up position where the take-up roller 10 takes up the web 13 is lost. Conversely, the pressing roller 8 rotating in the direction counter to the rotation direction R6 may pull the redundant web 13 from the supply roller 12, creating a slack in the web 13.

To address this problem, the take-up roller 10 takes up the web 13 during recovery operation after removal of the jammed recording medium P, eliminating the slack in the web 13. However, if the image forming apparatus 14 has a configuration that allows the user to rotate the pressing roller 8 in the direction counter to the rotation direction R6 accidentally, that is, even when the recording medium P is not jammed, the recovery operation is not performed, and therefore the web 13 is left slackened.

To address this problem, the image forming apparatus 14 according to the exemplary embodiments described above allows the user to rotate the pressing roller 8 and the fixing roller 5 solely by using the fixing knob 2 attached to the joint 4, thus prohibiting the user from rotating the pressing roller 8 and the fixing roller 5 accidentally. Consequently, the web 13 does not slack due to rotation of the pressing roller 8 in the direction counter to the rotation direction R6, preventing resultant faulty conveyance of the web 13 and faulty cleaning of the pressing roller 8. After the jammed recording medium P is removed from between the fixing roller 5 and the pressing roller 8, the take-up roller 10 takes up the web 13 during recovery operation, thus eliminating slack in the web 13 at reduced manufacturing costs without a complex mechanism that prevents slack in the web 13, such as a brake mechanism that stops the web 13 against the pressing roller 8 rotating in the direction counter to the rotation direction R6.

Referring to FIG. 9 to 12, the following describes removal of the jammed recording medium P from between the fixing roller 5 and the pressing roller 8.

Figure 9:
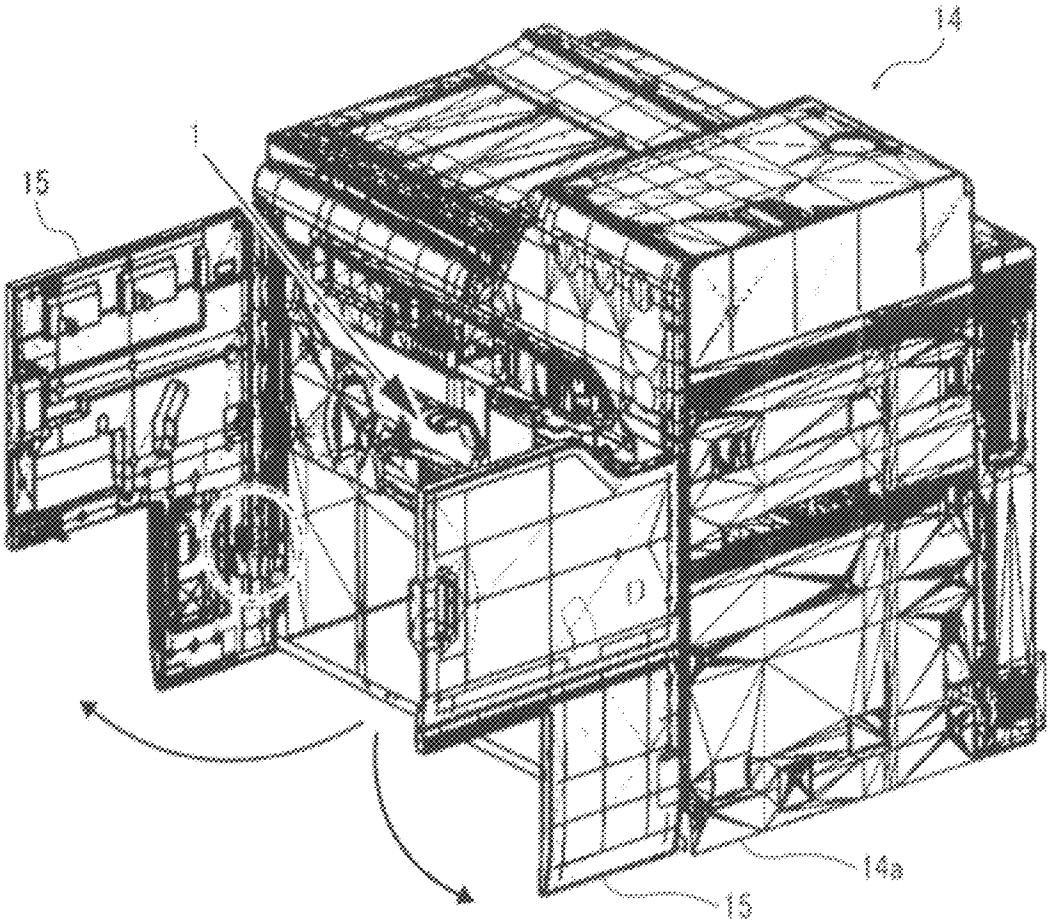
FIG. 9 is a perspective view of the image forming apparatus shown in FIG. 1 illustrating opened front covers and the fixing device incorporated therein.
Figure 10:
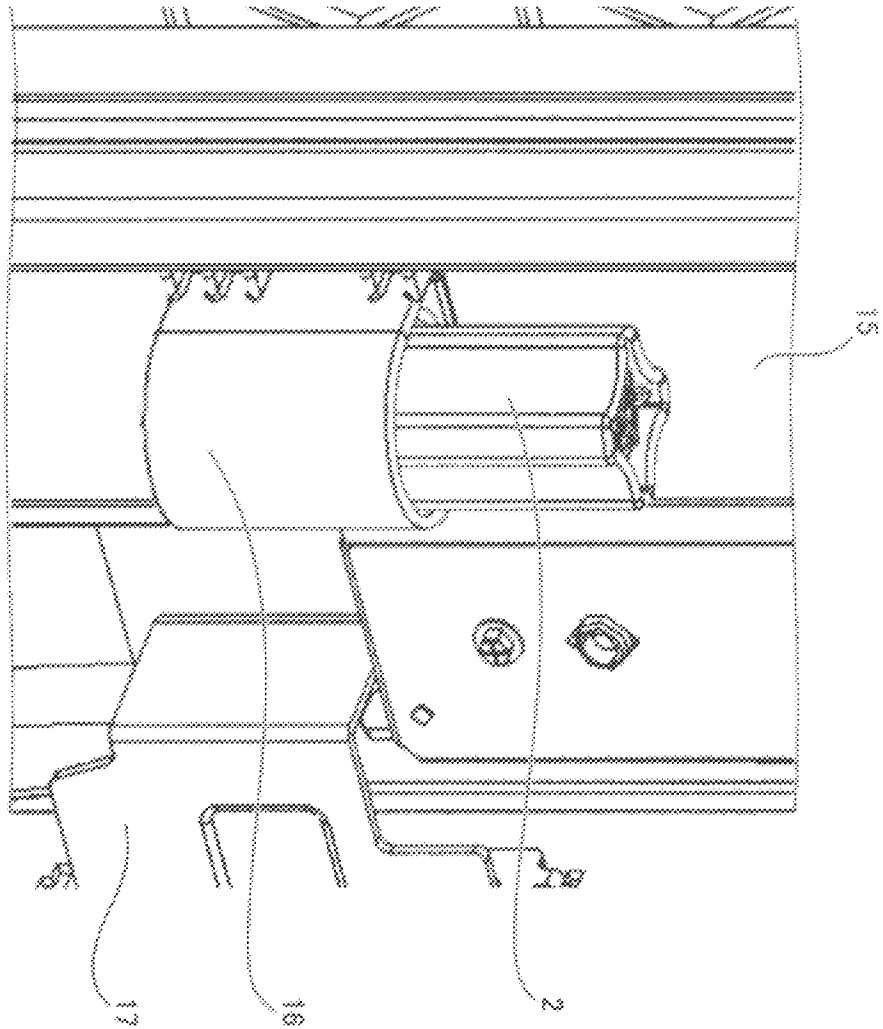
FIG. 10 is a perspective view of an interior wall of the front cover shown in FIG. 9.
Figure 11:
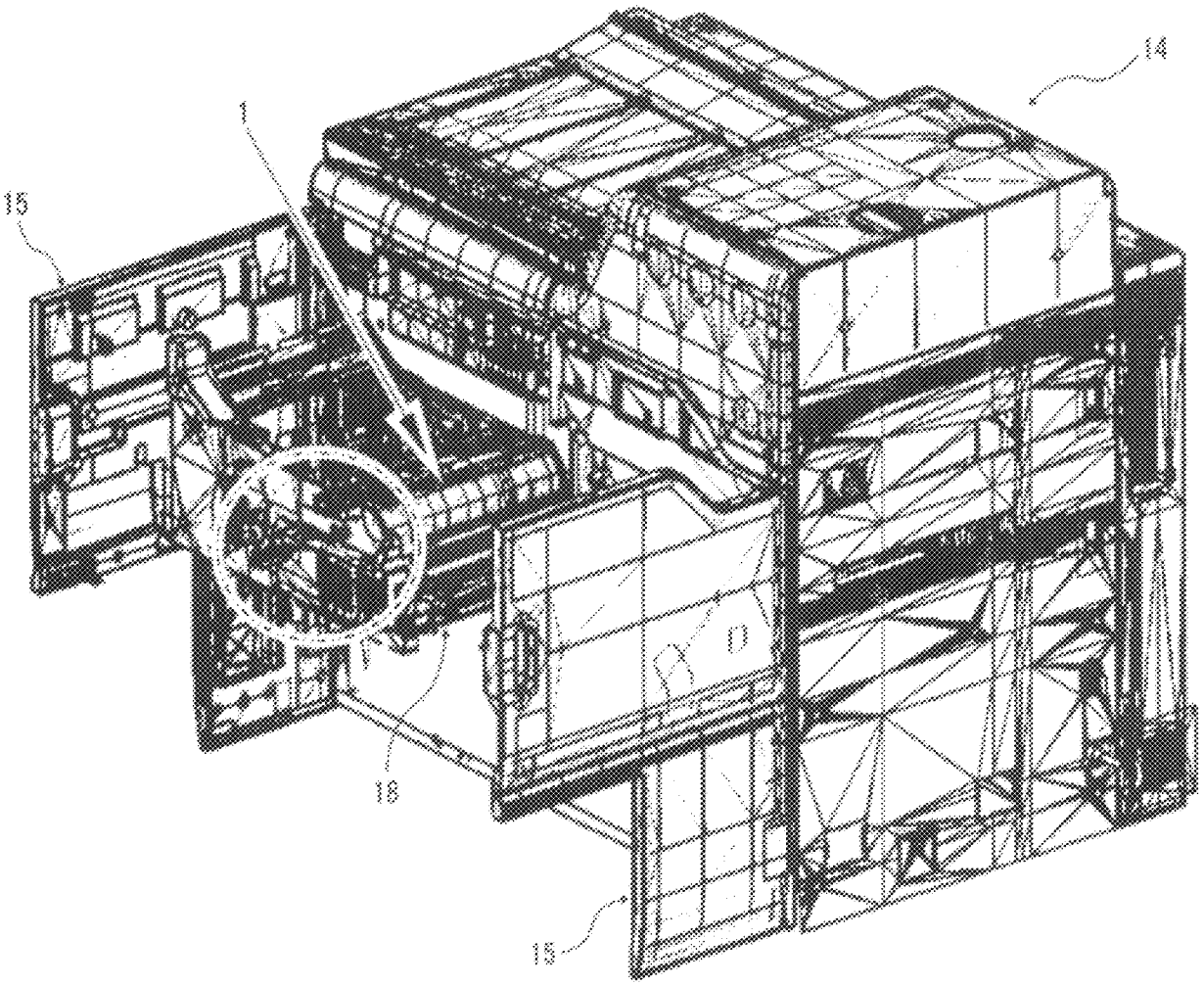
FIG. 11 is a perspective view of the image forming apparatus shown in FIG. 9 illustrating the fixing device shown in FIG. 9 pulled therefrom.
Figure 12:
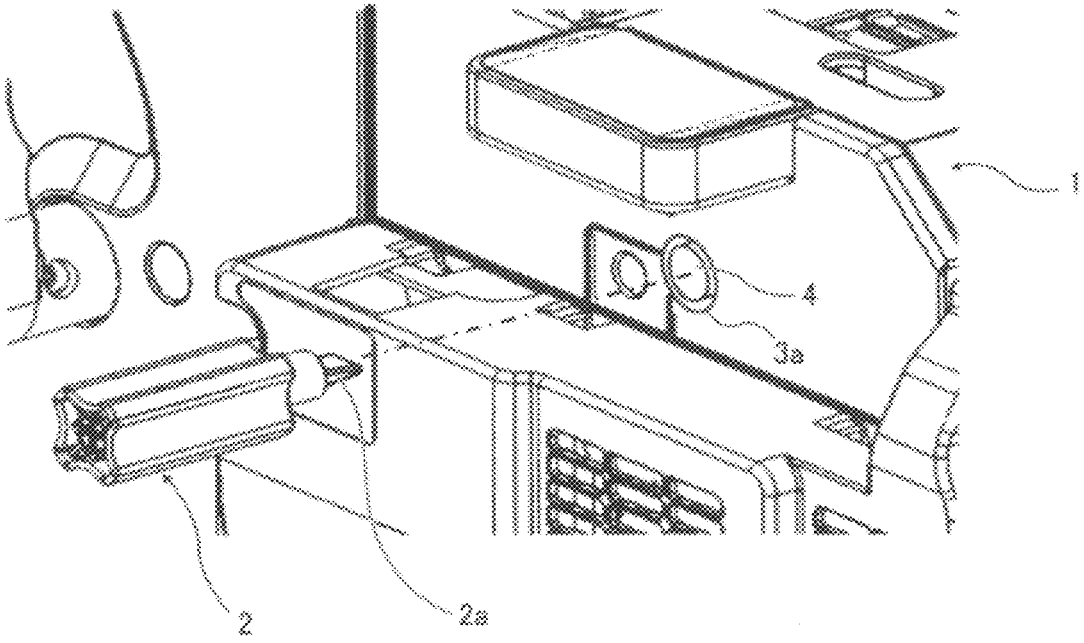
FIG. 12 is a perspective view of a front part of the fixing device enclosed by the broken line circle in FIG. 11.

FIG. 9 is a perspective view of the image forming apparatus 14 illustrating opened front covers 15. FIG. 10 is a perspective view of an interior wall of the front cover 15. FIG. 11 is a perspective view of the image forming apparatus 14 illustrating the fixing device 1 pulled from the image forming apparatus 14. FIG. 12 is a perspective view of a front part of the fixing device 1 enclosed by the broken line circle in FIG. 11. As shown in FIG. 9, the front covers 15 are double doors each of which is attached to an image forming apparatus body 14*a* via a hinge 17 shown in FIG. 10. FIG. 10 illustrates a region enclosed by the broken line circle in FIG. 9. As shown in FIG. 10, a cylindrical fixing knob holder 16 is mounted on the interior wall of the front cover 15. The fixing knob holder 16 has an opening at a top thereof through which the fixing knob 2 is inserted into the fixing knob holder 16.

If the recording medium P is jammed in the fixing device 1 while the image forming apparatus 14 is in operation, the user stops operating the image forming apparatus 14, opens the front covers 15, and pulls a drawer unit 18 surmounted with the fixing device 1 out of the image forming apparatus body 14*a* as shown in FIG. 11. Since the fixing device 1 surmounted on the drawer unit 18 is pulled as the user pulls the drawer unit 18, the user can remove the jammed recording medium P from the fixing device 1 readily.

In the event that it is difficult to remove the jammed recording medium P from the fixing device 1 pulled out of the image forming apparatus body 14*a* without rotating the fixing roller 5 and the pressing roller 8, the user picks up the fixing knob 2 from the fixing knob holder 16 exposed on the interior wall of the front cover 15 as the user opens the front cover 15. Then, the user attaches the fixing knob 2 to the joint 4 as shown in FIG. 12 and rotates the fixing knob 2 to rotate the fixing roller 5 and the pressing roller 8, causing the fixing roller 5 and the pressing roller 8 to discharge the jammed recording medium P from therebetween. Thereafter, the user picks up the jammed recording medium P from between the fixing roller 5 and the pressing roller 8.

Since the fixing knob 2 is stored in the fixing knob holder 16 mounted on the interior wall of the front cover 15 as shown in FIG. 10, the fixing knob 2 is not lost and the user can pick up the fixing knob 2 as soon as the recording medium P is jammed in the fixing device 1. For example, when the recording medium P is jammed, the user first opens the front covers 15. Instantly, the user picks up the fixing knob 2 from the interior wall of the front cover 15. That is, the fixing knob 2 stored in the fixing knob holder 16 mounted on the interior wall of the front cover 15 facilitates removal of the jammed recording medium P from the fixing device 1.

Further, the joint 4 is made of low conductive resin. When the user opens one of the front covers 15, driving of the fixing device 1 halts automatically. Accordingly, even if the user touches the joint 4, the user is not injured by heat and driving of the fixing device 1, attaining safety of the user.

Referring to FIG. 2, 5B, 6D, 8C, and 10, the following describes advantages of the fixing device 1 and the image forming apparatus 14 incorporating the fixing device 1.

As shown in FIG. 2, the fixing device 1 includes the fixing roller 5 serving as a fixing rotary body rotatable in the rotation direction R4 and heated by the halogen heater 21 via the fixing belt 6 and the pressing roller 8 serving as a pressing rotary body rotatable in the rotation direction R6 counter to the rotation direction R4 of the fixing roller 5 and separatably pressed against the fixing roller 5 to form the fixing nip NP therebetween. As a recording medium P bearing an unfixed toner image T is conveyed through the fixing nip NP to fix the toner image T on the recording medium P, an image side of the recording medium P bearing the unfixed toner image T contacts the fixing belt 6. Conversely, a non-image side of the recording medium P not bearing the unfixed toner image T contacts the pressing roller 8.

As shown in FIG. 5B, the fixing knob 2 is detachably attached to the joint 4 connected to the shaft 5*a* of the fixing roller 5. When the user manually rotates the fixing knob 2 attached to the joint 4, the joint 4 rotated by the fixing knob 2 rotates the shaft 5*a* of the fixing roller 5, thus rotating the fixing roller 5. The rotating fixing roller 5 rotates the pressing roller 8 depicted in FIG. 2 via the pair of connected gears interposed therebetween. Alternatively, the rotating fixing roller 5 may rotate the pressing roller 8 due to friction therebetween. Further, the joint 4 may be connected to the shaft of the pressing roller 8 instead of the shaft 5*a* of the fixing roller 5. In this case also, the rotating pressing roller 8 rotates the fixing roller 5 via the pair of connected gears interposed therebetween. Alternatively, the rotating pressing roller 8 may rotate the fixing roller 5 due to friction therebetween.

The fixing rotary body may be the fixing roller 5, the fixing belt 6 stretched over the plurality of rollers, or a fixing belt inside which a nip formation pad is disposed in such a manner that the pressing roller 8 is pressed against the nip formation pad via the fixing belt. Similarly, the pressing rotary body may be the pressing roller 8 or a pressing belt stretched over a plurality of rollers. Further, at least one of the fixing rotary body and the pressing rotary body may be heated by at least one heater. The heater may be a halogen heater, an induction heater, or the like.

Since the fixing knob 2 is detachably attached to the joint 4, the fixing knob 2 is not attached to the joint 4 during fixing operation. The user attaches the fixing knob 2 to the joint 4 only when necessary, for example, when the recording medium P is jammed between the fixing roller 5 and the pressing roller 8. Thus, the user rotates the fixing roller 5 and the pressing roller 8 by using the fixing knob 2 to remove the jammed recording medium P from between the fixing roller 5 and the pressing roller 8. Otherwise, the fixing knob 2 is not attached to the joint 4, prohibiting the user from rotating the fixing roller 5 and the pressing roller 8 accidentally and preventing failures that may arise due to accidental rotation of the fixing roller 5 and the pressing roller 8.

The joint 4 is connected to the fixing roller 5 or the pressing roller 8 and includes the concave female connector 4*a*1 depicted in FIG. 6B that engages the fixing knob 2. The fixing knob 2 includes the convex male connector 2*a* depicted in FIG. 6D that engages the concave female connector 4*a*1 of the joint 4 only. Since the concave female connector 4*a*1 of the joint 4 engages the convex male connector 2*a* of the fixing knob 2 only, the user can manually rotate the fixing roller 5 solely with the fixing knob 2. Accordingly, the user does not rotate the fixing roller 5 and the pressing roller 8 accidentally, preventing failures that may arise due to accidental rotation of the fixing roller 5 and the pressing roller 8 precisely.

The joint 4 is made of a low conductive material. As shown in FIG. 8C, the inlet 4*a*2 of the joint 4 through which the male connector 2*a* of the fixing knob 2 depicted in FIG. 6D is inserted into the female connector 4*a*1 of the joint 4 is situated inside the circular through-hole 3*a* produced through the fixing cover 3 in such a manner that the axis of the joint 4 is centered in the circular through-hole 3*a*. The clearance A not greater than about 4 mm is provided between the inner circumference of the circular through-hole 3*a* and the outer circumference of the joint 4. Since the joint 4 engages or is drivably connected to the fixing roller 5 or the pressing roller 8, the joint 4 is rotated as the fixing device 1 is driven. Accordingly, the clearance A is created between the inner circumference of the through-hole 3*a* and the outer circumference of the joint 4. However, the clearance A is not greater than about 4 mm, prohibiting the fingers of the user from touching the driver and the heated components situated inside the fixing device 1.

The joint 4 is made of a low conductive material such as low conductive resin. As the user opens the front cover 15 of the image forming apparatus 14, the fixing device 1 is turned off automatically for safety. Accordingly, even when the user touches the joint 4, the user is not injured by heat and driving of the fixing device 1, attaining safety of the user.

As shown in FIG. 2, the web 13 contacts the outer circumferential surface of the pressing roller 8 to clean the pressing roller 8. Alternatively, the web 13 may contact an outer circumferential surface of a fixing rotary body (e.g., the fixing belt 6 or a fixing roller) to clean the fixing rotary body. Since the joint 4 rotated solely by the fixing knob 2 prohibits accidental rotation of the fixing roller 5 and the pressing roller 8, the web 13 is not slackened by accidental rotation of the pressing roller 8, preventing faulty conveyance and cleaning of the web 13. The take-up roller 10 takes up the web 13 during recovery operation after the user manually rotates the fixing roller 5 and the pressing roller 8 to remove the jammed recording medium P from therebetween. Thus, slack in the web 13 created by manual rotation of the pressing roller 8 is eliminated at reduced manufacturing costs without a complex mechanism that prevents slack in the web 13, such as a brake mechanism that stops the web 13 against the pressing roller 8 manually rotated by the user.

As shown in FIG. 10, the fixing knob holder 16 that holds and stores the fixing knob 2 detached from the fixing device 1 is situated inside the image forming apparatus 14. Since the fixing knob 2 is stored in the fixing knob holder 16, it is not lost and is accessed by the user readily. For example, as soon as the recording medium P is jammed, the user can pick up the fixing knob 2 and attach it to the joint 4 for removal of the jammed recording medium P.

The fixing knob holder 16 is mounted on the interior wall of the front cover 15 of the image forming apparatus 14. Upon finding jamming of the recording medium P in the fixing device 1, the user opens the front cover 15 of the image forming apparatus 14 first. As soon as the user opens the front cover 15, the user can pick up the fixing knob 2 from the fixing knob holder 16 mounted on the interior wall of the front cover 15 and proceed with removal of the jammed recording medium P.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

a pressing rotary body, rotatable in a direction counter to the direction of rotation of the fixing rotary body, pressed against the fixing rotary body to form a fixing nip therebetween through which a recording medium bearing a toner image is conveyed;

a joint connected to a shaft of one of the fixing rotary body and the pressing rotary body and rotatable to rotate the one of the fixing rotary body and the pressing rotary body; and a fixing knob detachably attached to the joint and rotated manually by a user.

2. The fixing device according to claim 1, wherein the joint includes a concave female connector and the fixing knob includes a convex male connector to engage the concave female connector.

3. The fixing device according to claim 2, further comprising a fixing cover to cover a front of the fixing device and including a through-hole, wherein the joint includes an inlet through which the male connector of the fixing knob is inserted into the female connector of the joint, and wherein the inlet of the joint is situated inside the through-hole of the fixing cover in such a manner that an axis of the joint is centered in the through-hole.

4. The fixing device according to claim 3, wherein a clearance not greater than about 4 mm is provided between an inner circumference of the through-hole of the fixing cover and an outer circumference of the inlet of the joint.

5. The fixing device according to claim 4, wherein the joint is made of a low conductive material.

6. The fixing device according to claim 1, further comprising a cleaner slidably contacting an outer circumferential surface of one of the fixing rotary body and the pressing rotary body to clean the one of the fixing rotary body and the pressing rotary body.

7. The fixing device according to claim 6, wherein the cleaner includes:

a web made of a nonwoven fabric band impregnated with silicone oil and slidably contacting the outer circumferential surface of the one of the fixing rotary body and the pressing rotary body;

a cleaning roller to press the web against the outer circumferential surface of the one of the fixing rotary body and the pressing rotary body;

a supply roller to supply the web to the cleaning roller; and a take-up roller to take up the web from the cleaning roller, wherein the web is stretched over the supply roller, the cleaning roller, and the take-up roller.

8. The fixing device according to claim 1, wherein the fixing rotary body includes one of a fixing roller and a fixing belt and the pressing rotary body includes one of a pressing roller and a pressing belt.

9. An image forming apparatus comprising the fixing device according to claim 1.

10. The image forming apparatus according to claim 9, further comprising a fixing knob holder disposed inside the image forming apparatus and storing the fixing knob detached from the fixing device.

11. The image forming apparatus according to claim 10, further comprising a front cover to cover a front of the image forming apparatus, wherein the fixing knob holder is mounted on an interior wall of the front cover.

* * * * *